US010163415B2

(12) United States Patent
Jeon et al.

(10) Patent No.: US 10,163,415 B2
(45) Date of Patent: Dec. 25, 2018

(54) TRANSPARENT LIQUID CRYSTAL DISPLAY APPARATUS AND METHOD OF DRIVING THE SAME

(71) Applicant: Samsung Display Co., Ltd, Yongin-si, Gyeonggi-do (KR)

(72) Inventors: Jae-Gwan Jeon, Incheon (KR); Suk Jin Park, Daejeon (KR); Nam-Gon Choi, Yongin-si (KR); Akihiro Takegama, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 83 days.

(21) Appl. No.: 15/371,060

(22) Filed: Dec. 6, 2016

(65) Prior Publication Data

US 2017/0206848 A1 Jul. 20, 2017

(30) Foreign Application Priority Data

Jan. 19, 2016 (KR) ..... 10-2016-0006192

(51) Int. Cl.
*G09G 3/36* (2006.01)
*G09G 3/20* (2006.01)

(52) U.S. Cl.
CPC ..... *G09G 3/3677* (2013.01); *G09G 3/2003* (2013.01); *G09G 3/2007* (2013.01); *G09G 3/3688* (2013.01); *G09G 2300/0426* (2013.01); *G09G 2310/08* (2013.01); *G09G 2320/0276* (2013.01); *G09G 2320/0626* (2013.01); *G09G 2320/08* (2013.01); *G09G 2340/06* (2013.01); *G09G 2360/144* (2013.01)

(58) Field of Classification Search
CPC ..... G09G 2320/0673; G09G 2360/144; G06K 9/4642
See application file for complete search history.

(56) References Cited

U.S. PATENT DOCUMENTS

2006/0088275 A1* 4/2006 O'Dea ..... H04N 5/58 386/304
2014/0132618 A1* 5/2014 Su ..... G09G 3/20 345/589
2015/0228224 A1* 8/2015 Park ..... G09G 3/3233 345/691
2017/0116712 A1* 4/2017 Liao ..... G06K 9/4604

FOREIGN PATENT DOCUMENTS

KR 10-2010-0138451 A 12/2010
KR 10-1174147 B1 8/2012
KR 10-2014-0097742 A 8/2014

* cited by examiner

*Primary Examiner* — Sepehr Azari
(74) *Attorney, Agent, or Firm* — Innovation Counsel LLP

(57) ABSTRACT

A method of driving a transparent liquid crystal display apparatus includes a transparent display panel including a brightness sensor and a timing controller. The timing controller includes a YCbCr converter configured to convert input pixel data to YCbCr data, a histogram extractor configured to receive the YCbCr data and generate histogram information about the number of values corresponding to each of brightness data, a grayscale analysis unit configured to analyze the histogram information and determine a type of an input image, an image processer configured to process the YCbCr data according to the type of the input image and the ambient brightness information and generate an output YCbCr' data, and an RGB converter configured to convert the output YCbCr' data to output image data.

16 Claims, 9 Drawing Sheets

TRANSPARENT LIQUID CRYSTAL DISPLAY APPARATUS AND METHOD OF DRIVING THE SAME

This application claims priority to and the benefit of Korean Patent Application No. 10-2016-0006192, filed on Jan. 19, 2016, the disclosure of which is incorporated by reference herein in its entirety.

BACKGROUND

1. Field

Exemplary embodiments of the inventive concept relate to a transparent liquid crystal display apparatus.

More particularly, exemplary embodiments of the inventive concept relate to a transparent liquid crystal display apparatus using an external light.

2. Description of the Related Art

Recently, a transparent display apparatus, which can simultaneously display an image and transmit light through the transparent display apparatus so that an object behind the transparent display apparatus is visible to users, has been developed. A liquid crystal display apparatus, which displays an image by changing an arrangement of liquid crystal molecules, usually uses an additional light source such as a backlight unit to display the image. A transparent liquid crystal display apparatus may use an ambient light instead of light from the backlight unit.

Maximum brightness of the transparent liquid crystal display apparatus is limited by the ambient light. When the ambient light is relatively weak, the transparent liquid crystal display apparatus has a low display quality due to an insufficient maximum brightness.

SUMMARY

One or more exemplary embodiments of the inventive concept provide a transparent liquid crystal display apparatus capable of improving display quality even though an ambient light is relatively weak.

One or more exemplary embodiments of the inventive concept also provide a method of driving the transparent liquid crystal display apparatus.

According to an exemplary embodiment of the inventive concept, a transparent liquid crystal display apparatus includes a transparent display panel including a liquid crystal layer and using an ambient light as a light source to display an image, a timing controller configured to receive an input image data and output an output image data, and a brightness sensor configured to sense a brightness of an ambient light and provide an ambient brightness information to the timing controller. The input image data includes input pixel data each of which comprises red grayscale data, green grayscale data and blue grayscale data. The timing controller includes a YCbCr converter configured to convert the input pixel data to YCbCr data, wherein the YCbCr data has YCbCr pixel data for the pixels, and each of the YCbCr data has a brightness data which is a brightness information corresponding to the pixel, a histogram extractor configured to receive the YCbCr data and generate a histogram information about the number of values corresponding to each of the brightness data, a grayscale analysis unit configure to analysis the histogram information and determine a type of an input image, an image processer configured to process the YCbCr data according to the type of the input image and the ambient brightness information and generate an output YCbCr' data, and a RGB converter configured to convert the output YCbCr' data to output image data, wherein the output image data comprises an output pixel data each of which comprises red grayscale data, green grayscale data and blue grayscale data.

In an exemplary embodiment, the grayscale analysis unit may determine the type of the input image as an A-type when frequency distribution of the histogram information is relatively high at the middle thereof. The grayscale analysis unit may determine the type of the input image as a V-type when frequency distribution of the histogram information is relatively low at the middle thereof.

In an exemplary embodiment, grayscale analysis unit may count the number of low brightness values from the histogram information, and count the number of high brightness values from the histogram information. The low brightness value may be smaller than a reference low brightness. The high brightness value may be greater than a reference high brightness. The number of middle brightness value may be determined by subtracting sum of the number of low brightness values and the number of high brightness values from the number of entire brightness values of the histogram information. When a ratio of the number of middle brightness values to the number of the entire brightness values is smaller than a reference low ratio, the type of the input image may be determined as the V-type. When a ratio of the number of middle brightness values to the number of the entire brightness values is larger than a reference high ratio, the type of the input image may be determined as the A-type.

In an exemplary embodiment, the brightness data value may have a value of 0 to 255. The reference low brightness may be 85. The reference high brightness may be 170. The reference low ratio may be 30%. The reference high ratio may be 70%.

In an exemplary embodiment, the transparent liquid crystal display apparatus may further include a LUT storage unit which stores a lookup table having input to output mapping information for each of the type of the input image.

In an exemplary embodiment, in the lookup table, output range corresponding to brightness data range having more image information may be set to be widened, and output range corresponding to brightness data range having less image information may be set to be narrower.

In an exemplary embodiment, the LUT storage unit may further include a bypass lookup table which output input value as it is.

In an exemplary embodiment, the image processer may generate the output YCbCr' data which includes output brightness data using the equation below.

$$\text{output brightness data } Y' = \text{bypass lookup table}(Y) + (\text{lookup table}(Y) - \text{bypass lookup table}(Y)) * \text{weight factor WF} \quad \text{[equation]}$$

(Here, the bypass lookup table(Y) means output of the bypass lookup table corresponding to the input brightness data Y, lookup table(Y) means output of the lookup table for each of the type of the input image corresponding to the input brightness data Y, weight factor WF has a value 0 to 1 according to the ambient brightness information)

According to an exemplary embodiment of the inventive concept, a transparent liquid crystal display apparatus includes a transparent display panel comprising a liquid crystal layer and using an ambient light as a light source to display an image, a gate driver configured to provide a gate signal to drive the transparent display panel, a data driver configured to provide a data signal to drive the transparent display panel, and a timing controller configured to provide a control signal to the gate driver and the data driver.

Brightness corresponding to a specific grayscale when a first input image is inputted and brightness corresponding to the specific grayscale when a second input image is inputted are different each other. The second input image has a brightness distribution different from that of the first input image.

In an exemplary embodiment, the transparent liquid crystal display apparatus may further include a brightness sensor configured to sense a brightness of an ambient light. According to brightness change of the ambient light, amount of brightness change of the first input image and amount of brightness change of the second input image may be different from each other.

In an exemplary embodiment, according to change of grayscale of the input image at a portion of the input image, a gamma reference voltage of the data driver corresponding to the portion may be changed.

According to an exemplary embodiment of the inventive concept, a method of driving a transparent liquid crystal display apparatus includes converting input image to YCbCr data, extracting a histogram about brightness data from the YCbCr data, analyzing the histogram to determine a type of the input image, generating output YCbCr data from the YCbCr data according to the type of the input image, and converting the output YCbCr' data to output image comprising red grayscale data, green grayscale data and blue grayscale data In an exemplary embodiment, the method may further include sensing brightness of an ambient light. The output YCbCr' data may be generated with application of a weight factor according to the brightness of an ambient light.

In an exemplary embodiment, the weight factor may be relatively large when the ambient light is relatively weak, and is relatively small when the ambient light is relatively strong.

In an exemplary embodiment, in generating output YCbCr data, a lookup table which includes input to output mapping information for each of the type of the input image may be used.

In an exemplary embodiment, input to output mapping information of the lookup table may be set such that output range corresponding to brightness data range having more image information is set to be widened, and output range corresponding to brightness data range having less image information is set to be narrower.

In an exemplary embodiment, the output YCbCr' data which includes output brightness data may be calculated using the equation below.

$$\text{output brightness data } Y' = \text{bypass lookup table}(Y) + (\text{lookup table}(Y) - \text{bypass lookup table}(Y)) * \text{weight factor WF} \quad \text{[equation]}$$

Here, the bypass lookup table(Y) means output of the bypass lookup table corresponding to the input brightness data Y, lookup table(Y) means output of the lookup table for each of the type of the input image corresponding to the input brightness data Y, weight factor WF has a value 0 to 1 according to the ambient brightness information, bypass lookup table outputs input value as it is.

In an exemplary embodiment, in analyzing the histogram, the number of low brightness values from the histogram information may be counted, and the number of high brightness values from the histogram information may be counted. The low brightness value may be smaller than a reference low brightness. The high brightness value may be greater than a reference high brightness. The number of middle brightness value may be determined by subtracting sum of the number of low brightness values and the number of high brightness values from the number of entire brightness values of the histogram information. When a ratio of the number of middle brightness values to the number of the entire brightness values is smaller than a reference low ratio, the type of the input image may be determined as the V-type. When a ratio of the number of middle brightness values to the number of the entire brightness values is larger than a reference high ratio, the type of the input image may be determined as the A-type. In generating output YCbCr data, first and second lookup tables which have input to output mapping information for the V-type and A-type, respectively, may be used.

In an exemplary embodiment, in analyzing the histogram, when the histogram information has relatively many information at high brightness range which is greater than a reference high brightness, the type of the input image may be determined as high-type.

When the histogram information has relatively many information at middle brightness range which is between a reference low brightness and the high reference brightness, the type of the input image may be determined as middle-type. When the histogram information has relatively many information at low brightness range which is smaller than a reference high brightness, the type of the input image may be determined as low-type. In generating output YCbCr data, first to third lookup tables which have input to output mapping information for the high-type, the middle-type and the low-type, respectively, may be used.

In an exemplary embodiment, the method may further include directly adjusting a gamma reference voltage of a driving circuit according to the type of the input image.

According to the present inventive concept, a timing controller of a transparent liquid crystal display apparatus extracts brightness histogram from input image data and generates output image data that its dynamic range is improved. Brightness of an ambient light is sensed and a weight factor is applied, so that visibility of an image displayed on the transparent liquid crystal display apparatus may be improved regardless of the brightness of the an ambient light.

BRIEF DESCRIPTION OF THE DRAWINGS

The above and other features of the inventive concept will become more apparent by describing in detail exemplary embodiments thereof with reference to the accompanying drawings, in which.

DETAILED DESCRIPTION

Hereinafter, the inventive concept will be explained in detail with reference to the accompanying drawings.

Figure 1:
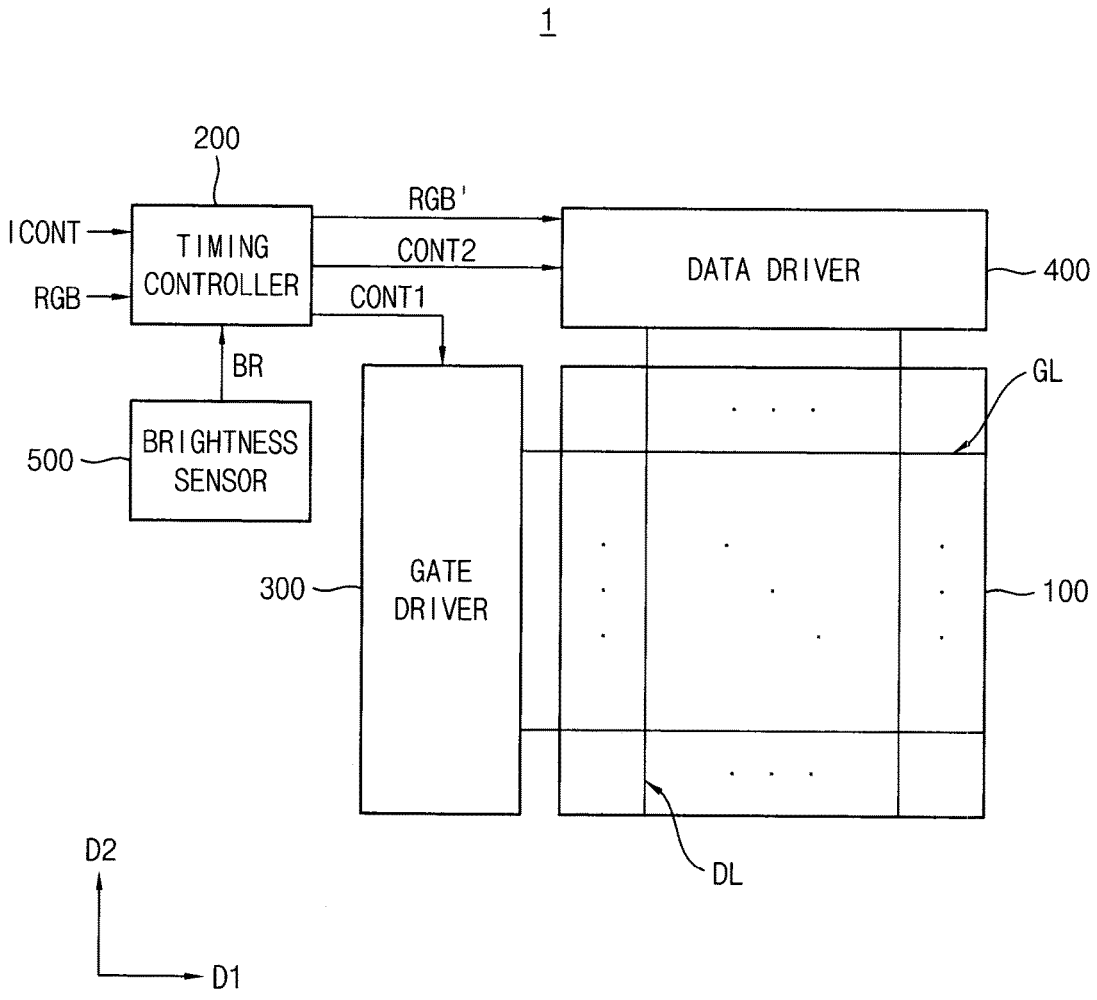
FIG. 1 is a block diagram illustrating a transparent liquid crystal display apparatus according to an exemplary embodiment of the inventive concept.
Figure 2:
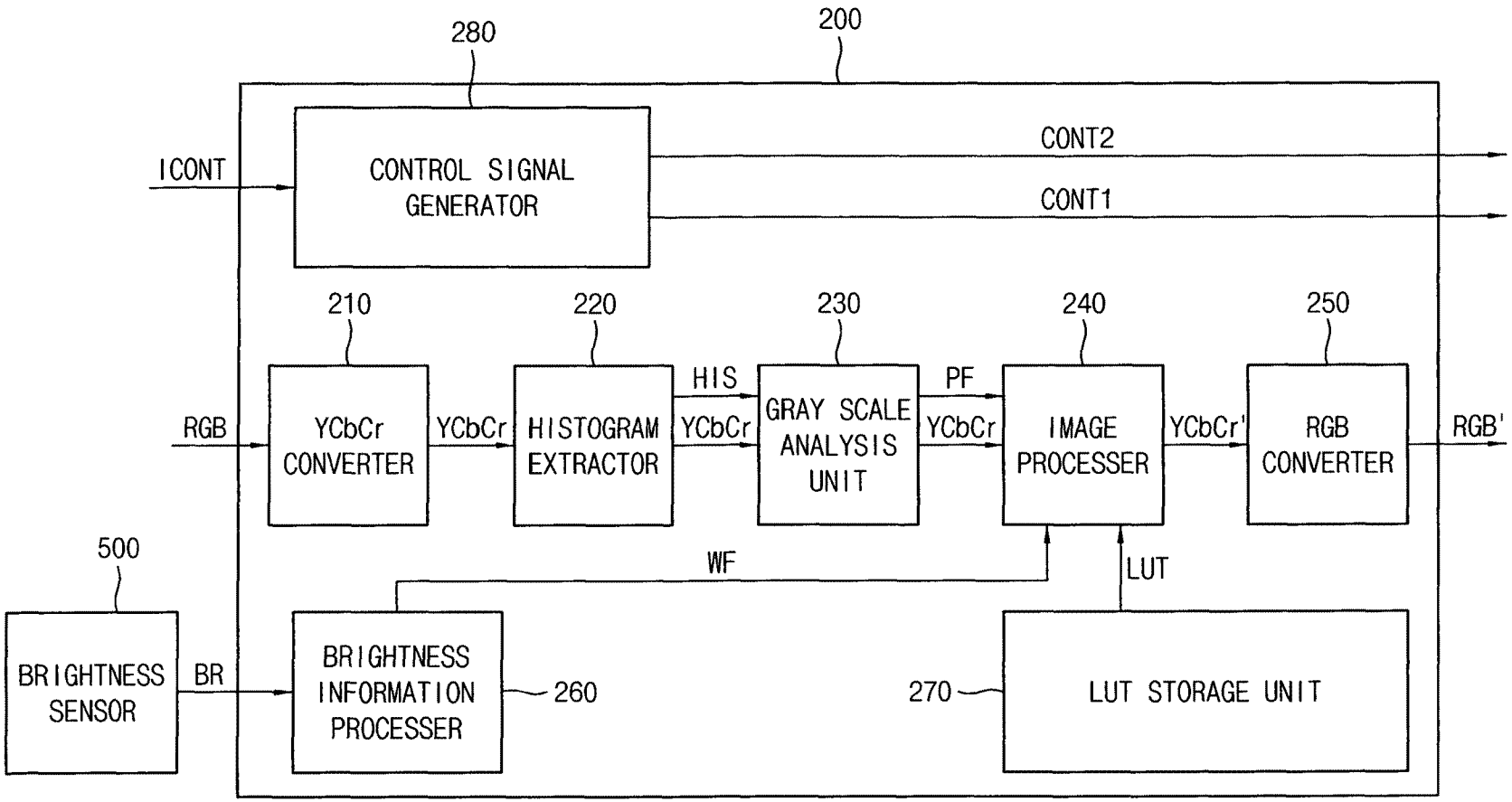
FIG. 2 is a block diagram of a timing controller of FIG. 1.

FIG. 1 is a block diagram illustrating a transparent liquid crystal display apparatus according to an exemplary embodiment of the inventive concept. FIG. 2 is a block diagram of a timing controller of FIG. 1.

Referring to FIGS. 1 and 2, the transparent liquid crystal display apparatus 1 may include a display panel 100, a timing controller 200, a gate driver 300, a data driver 400 and a brightness sensor 500.

The display panel 100 is connected to a plurality of gate lines GL and a plurality of data lines DL. The display panel 100 displays an image represented by a plurality of grayscales based on output image data RGB' The gate lines GL may extend in a first direction D1, and the data lines DL may extend in a second direction D2 crossing (e.g., substantially perpendicular to) the first direction D1.

The display panel 100 may include a plurality of pixels that are arranged in a matrix form. Each pixel may be electrically connected to a respective one of the gate lines GL and a respective one of the data lines DL.

The display panel 100 includes a liquid crystal layer. The liquid crystal layer may include liquid crystal molecules having optical anisotropy. The liquid crystal molecules may be driven by an electric field, so that an image may be displayed by passing or blocking light through the liquid crystal layer. The display panel 100 may be a transparent display panel which can transmit an external light through the transparent display panel and display an image. The display panel 100 may be transparent and include the liquid crystal layer, so that the display panel 100 may display the image using an ambient light as a light source instead of an additional light source.

In some exemplary embodiments, each pixel may include a switching element (not illustrated), a liquid crystal capacitor (not illustrated) and a storage capacitor (not illustrated). The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. For example, each pixel may have a relatively short side in the first direction D1 which is shorter in relation to a relatively long side in the second direction D2. The relatively short side of each pixel may be substantially parallel to the gate lines GL. The relatively long side of each pixel may be substantially parallel to the data lines DL.

The timing controller 200 controls an operation of the display panel 100 and controls operations of the gate driver 300 and the data driver 400. The timing controller 200 receives input image data RGB and an input control signal ICONT from an external device (not illustrated), e.g., a graphic processor. The input image data RGB may include a plurality of input pixel data for the plurality of pixels. The input pixel data may include red grayscale data R, green grayscale data G and blue grayscale data B. The input control signal ICONT may include a master clock signal, a data enable signal, a vertical synchronization signal, a horizontal synchronization signal, and the like.

The timing controller 200 generates the output image data RGB', a first control signal CONT1 and a second control signal CONT2 based on the input image data RGB and the input control signal ICONT.

The timing controller 200 may generate the output image data RGB' based on the input image data RGB. The output image data RGB', which may be digital, may be provided to the data driver 400. The timing controller 200 may generate the first control signal CONT1 based on the input control signal ICONT. The first control signal CONT1 may be provided to the gate driver 300, and a driving timing of the gate driver 300 may be controlled based on the first control signal CONT1. The first control signal CONT1 may include a vertical start signal, a gate clock signal, and the like. The timing controller 200 may generate the second control signal CONT2 based on the input control signal ICONT. The second control signal CONT2 may be provided to the data driver 400, and a driving timing of the data driver 400 may be controlled based on the second control signal CONT2. The second control signal CONT2 may include a horizontal start signal, a data clock signal, a data load signal, a polarity control signal, and the like.

The gate driver 300 receives the first control signal CONT1 from the timing controller 200. The gate driver 300 generates a plurality of gate signals for driving the gate lines GL based on the first control signal CONT1. The gate driver 300 may sequentially apply the gate signals to the gate lines GL.

The data driver 400 receives the second control signal CONT2 and the output image data RGB' from the timing controller 200. The data driver 400 generates a plurality of analog data voltages based on the second control signal CONT2 and the output image data RGB'. The data driver 400 may apply the data voltages to the data lines DL.

In some exemplary embodiments, the data driver 400 may include a shift register (not illustrated), a latch (not illustrated), a signal processor (not illustrated) and a buffer (not illustrated). The shift register may output a latch pulse to the latch. The latch may temporarily store the output image data, which may be digital, and may output the output image data to the signal processor. The signal processor may generate the analog data voltages based on the output image data and may output the analog data voltages to the buffer. The buffer may output the analog data voltages to the data lines DL.

In some exemplary embodiments, the gate driver 300 and/or the data driver 400 may be disposed, e.g., directly mounted, on the display panel 100, or may be connected to the display panel 100 in a tape carrier package (TCP) type. Alternatively, the gate driver 300 and/or the data driver 400 may be integrated on the display panel 100.

The brightness sensor 500 senses a brightness of an ambient light around the transparent liquid crystal display apparatus 1 to provide an ambient brightness information BR to the timing controller 200. The ambient brightness information BR includes information about the brightness of an ambient light around the transparent liquid crystal display apparatus 1. The brightness sensor 500 may sense a brightness of an external light to generate the ambient brightness information BR. For example, the brightness sensor 500 may sense the brightness of the external light around the transparent liquid crystal display apparatus 1 and generate the ambient brightness information BR in units of brightness, nt (i.e., nit), and then provide the ambient brightness information BR to the timing controller 200.

The transparent liquid crystal display apparatus 1 may display an image using the external light as a light source. The transparent liquid crystal display apparatus 1 may not include an additional light source such as a backlight unit, unlike a traditional liquid crystal display apparatus, and the transparent liquid crystal display apparatus 1 displays the image without such an additional light source even if surroundings are dark. For example, when the ambient brightness is less than 5 nt (nit), a dynamic range of the transparent liquid crystal display apparatus 1 becomes low. The dynamic range may be improved by generating the output image data RGB' based on the input image data RGB in consideration of the ambient brightness information BR. Detailed explanation will be given below.

Referring again to FIG. 2, the timing controller 200 includes a YCbCr converter 210, a histogram extractor 220, a grayscale analysis unit 230, an image processer 240, a RGB converter 250, a brightness information processer 260, LUT storage unit 270, a control signal generator 280.

The YCbCr converter 210 receives the input image data RGB and converts the input image data RGB to a YCbCr data YCbCr, and then provides the YCbCr data YCbCr to the histogram extractor 220. The input image data RGB may include a plurality of input pixel data for the plurality of pixels. The input pixel data may include red grayscale data R, green grayscale data G and blue grayscale data B.

The YCbCr data YCbCr includes a plurality of YCbCr pixel data for the plurality of pixels. The YCbCr pixel data may include brightness data Y which is brightness information and a color difference CbCr data which is color information. The YCbCr converter 210 may convert the input image data RGB to the YCbCr data YCbCr by a traditional and/or well-known method.

The histogram extractor 220 receives the YCbCr data YCbCr from the YCbCr converter 210, and generates a histogram information HIS, and then provides the histogram information HIS to the grayscale analysis unit 230. For example, histogram extractor 220 may count the number of values (i.e., a frequency distribution) which correspond to each of the brightness data Y from the YCbCr pixel data of the YCbCr data YCbCr, and generate a histogram displaying the frequency distribution of the brightness data Y of the YCbCr pixel data.

The grayscale analysis unit 230 receives the histogram information HIS from the histogram extractor 220, and determines a type of an input image by analyzing the histogram information HIS. The grayscale analysis unit 230 generates a profile information PF which includes information about the type of the input image, and provides the profile information PF to the image processer 240. For example, the grayscale analysis unit 230 may analyze the histogram information HIS, and may determine the type of the input image as an A-type when the frequency distribution is relatively high at the middle thereof. The grayscale analysis unit 230 may determine the type of the input image as a V-type when the frequency distribution is relatively low at the middle thereof.

More specifically, the brightness data Y may have a value from 0 to 255, and the grayscale analysis unit 230 may count the number of low brightness values from the histogram information HIS, and furthermore may count the number of high brightness values from the histogram information HIS. Each low brightness value is smaller than a reference low brightness (for example, (⅓)*255=85). Each high brightness value is greater than a reference high brightness (for example, (⅔)*255=170). The grayscale analysis unit 230 may calculate the number of middle brightness values by subtracting the sum of the number of low brightness values and the number of high brightness values from the total number of brightness values of the histogram information HIS (number of middle brightness values=total number of brightness values (number of high brightness values+number of low brightness values)). The total number of brightness values may count all brightness values of the histogram information HIS, whether each brightness value is smaller, greater, or equal to a reference low brightness or a reference high brightness. When a ratio of the number of middle brightness values to the total number of brightness values is smaller than a reference low ratio (for example, 30%), the type of the input image may be determined as the V-type. In addition, when a ratio of the number of middle brightness values to the total number of brightness values is larger than a reference high ratio (for example, 70%), the type of the input image may be determined as the A-type.

The reference low brightness, the reference high brightness, the reference low ratio and the reference high ratio may be properly determined. In addition, the type of the input image may include other types than the V-type and A-type. For example, the type of the input image may further include a high-type, a middle-type, and a lowtype. The grayscale analysis unit 230 may analyze the histogram information HIS, and determine the type of the input image as the high-type, the middle-type, or the low-type when a high brightness information is relatively major, a middle brightness information is relatively major, or a low brightness information is relatively major, respectively. In addition, when the input image does not need a correction process, the input image may be determined as a bypass type, and a bypass lookup table (to be described below) may be applied.

The brightness information processer 260 receives the ambient brightness information BR from the brightness sensor 500 and generates a weight factor WF. The weight factor WF may have a value of from 0 to 1, and may be set according to the ambient brightness information BR.

The weight factor WF may have a relatively greater value to increase a data correction amount when the ambient brightness information BR is relatively low. For example, when the ambient brightness information BR is smaller than 5 nt, the weight factor WF may be set as 1. When the ambient brightness information BR is greater than 400 nt, the weight factor WF may be set as 0. When the ambient brightness information BR is from 5 to 400 nt, the weight factor WF may be set as or between from 1 to 0, and the weight factor WF may be set in non-linear inverse proportion to the ambient brightness information BR.

In an example embodiment, the brightness information processer 260 may be a microcomputer which is included in the timing controller.

The LUT storage unit 270 may store output data corresponding to input data of each of the type of the input image. For example, the LUT storage unit 270 may store a lookup table LUT which includes output grayscale mapping information corresponding to input grayscale of each of the type of the input image. In addition, the LUT storage unit 270 may further include the bypass lookup table which outputs the input grayscale itself.

More particularly, a Y value (input) to Y' value (output) curve may be stored at the LUT storage unit 270. The curve may map the brightness data Y to the output brightness data Y'. Thus, the LUT storage unit 270 may store a first lookup table for the V-type, a second lookup table for the A-type, and the bypass lookup table.

In the lookup table, a range of Y' values (output) corresponding to a specific range of Y values (input) that are more frequent than other values may be set to be wider than the original range. A range of Y' values (output)corresponding to a specific range of Y values (input) that are less frequent than other values may be set to be narrower than the original range. Thus, a brightness range having more image information is widened, and a brightness range having less image information is narrowed, so that display quality of the transparent liquid crystal display apparatus may be improved even though the ambient light is weak.

The LUT storage unit 270 may include at least one nonvolatile memory such as an erasable programmable read-only memory (EPROM), an electrically erasable programmable read-only memory (EEPROM), a flash memory, a phase change random access memory (PRAM), a ferroelectric random access memory (FRAM), a resistance random access memory (RRAM), a magnetic random access memory (MRAM), and the like. The LUT storage unit 270 may provide an information LUT about the lookup table and the bypass lookup table to the image processer 240.

The image processer 240 receives the profile information PF and the YCbCr data YCbCr and outputs output YCbCr data YCbCr'. The image processer 240 may process the YCbCr data YCbCr and generate the output YCbCr data YCbCr' using the information LUT in consideration of the profile information PF. For example, the image processer 240 may receive the information LUT, which includes input grayscale to output grayscale mapping information, from the LUT storage unit 270. The image processer 240 may process the YCbCr data YCbCr and generate the output YCbCr data YCbCr'. Here, considering also the weight factor WF from the brightness information processer 260, the output YCbCr data YCbCr' may be generated. Thus, when brightness of the external light is relatively high, the transparent display apparatus may represent a relatively large range of brightness, so that the weight factor WF may be relatively small, and influence of the bypass lookup table may be increased. When the brightness of the external light is relatively low, the transparent display apparatus can represent a relatively small range of brightness, so that the weight factor WF may be relatively large, and influence of the lookup table according to the type of the input image may be increased.

For example, the output brightness data Y' of the output YCbCr data YCbCr' may be calculated using a following equation from the brightness data Y of the YCbCr data YCbCr $$\text{output brightness data } Y' = \text{bypass lookup table}(Y) + (\text{lookup table}(Y) - \text{bypass lookup table}(Y)) * \text{weight factor WF} \quad \text{[equation]}$$

Here, the bypass lookup table(Y) means output of the bypass lookup table corresponding to the input brightness data Y, while lookup table(Y) means output of the lookup table for each of the type of the input image corresponding to the input brightness data Y.

The RGB converter 250 receives the output YCbCr data YCbCr' from the image processer 240, and converts the output YCbCr data YCbCr' to the output image data RGB'. The RGB converter 250 provides the output image data RGB' to the data driver 400. The output image data RGB' may include a plurality of output pixel data for the plurality of the pixels. The output pixel data may include red grayscale data R, green grayscale data G and blue grayscale data B. The RGB converter 250 may convert the output YCbCr data YCbCr' to the output image data RGB' by a traditional and/or well-known method.

The control signal generator 280 may receive the input control signal ICONT, and may generate the first control signal CONT1 and the second control signal CONT2 based on the input control signal ICONT. The first control signal CONT1 may be provided to the gate driver 300, and a driving timing of the gate driver 300 may be controlled based on the first control signal CONT1. The second control signal CONT2 may be provided to the data driver 400, and a driving timing of the data driver 400 may be controlled based on the second control signal CONT2.

Figure 3:
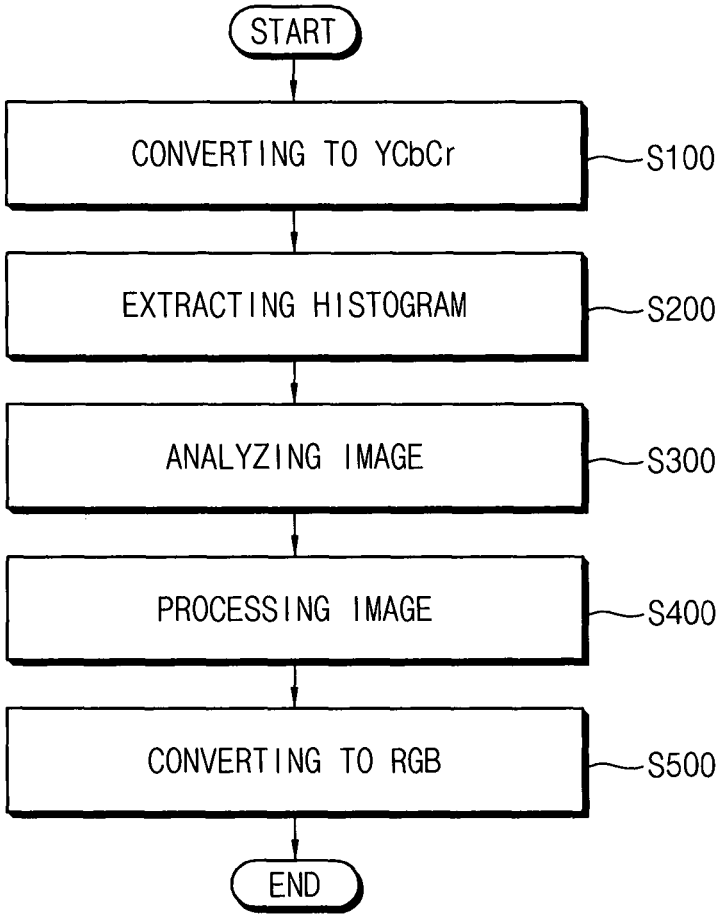
FIG. 3 is a flow chart illustrating a method of driving the transparent liquid crystal display apparatus of FIG. 1.

FIG. 3 is a flow chart illustrating a method of driving the transparent liquid crystal display apparatus of FIG. 1.

Referring to FIGS. 1, 2 and 3, the method includes converting to YCbCr (S100), extracting histogram (S200), analyzing image (S300), processing image (S400) and converting to RGB (S500).

In converting to YCbCr (S100), an input image data RGB is received and converted to a YCbCr data YCbCr. The input image data RGB may include a plurality of input pixel data for a plurality of pixels. The input pixel data may include red grayscale data R, green grayscale data G and blue grayscale data B.

The YCbCr data YCbCr may include a plurality of YCbCr pixel data for the plurality of pixels. The YCbCr pixel data may include brightness data Y, which is brightness information, and a color difference CbCr data, which is color information. The input image data RGB may be converted to the YCbCr data YCbCr by a traditional and/or well-known method.

In the extracting histogram (S200), histogram information HIS is generated based on the YCbCr data YCbCr. For example, the number of values (frequency distribution) which correspond to each of the brightness data Y from the YCbCr pixel data of the YCbCr data YCbCr may be counted, and a histogram of frequency distribution of the brightness data Y of the YCbCr pixel data may be generated.

In analyzing image (S300), a type of an input image is determined by analyzing the histogram information HIS. For example, the histogram information HIS may be analyzed, and the type of the input image may be determined as an A-type when the frequency distribution is relatively high at the middle thereof. The type of the input image may be determined as a V-type when the frequency distribution is relatively low at the middle thereof. In addition, the type of the input image may be types other than the V-type or A-type.

In processing image (S400), output YCbCr data YCbCr' is generated based on the YCbCr data YCbCr according to the type of the input image. For example, using a lookup table (LUT) according to the type of the input image, the brightness data Y of the YCbCr data YCbCr may be mapped to the output brightness data Y' of the output YCbCr data YCbCr'.

The method may further include generating an ambient brightness information BR by sensing brightness of the ambient light. Here, using a weight factor WF having a value of from 0 to 1 according to the ambient brightness information BR, the changing of the amount of brightness data may be controlled. For example, when brightness of an external light is relatively high, the transparent display apparatus may represent a relatively large range of brightness, so that the weight factor WF may be relatively small, and influence of the bypass lookup table may be increased. When the brightness of the external light is relatively low, the transparent display apparatus may represent a relatively small range of brightness, so that the weight factor WF may be relatively great, and influence of the lookup table according to the type of the input image may be increased.

In converting RGB (S500), the output YCbCr data YCbCr' is converted to output image data RGB'. The output image data RGB' may include a plurality of output pixel data for the plurality of the pixels. The output pixel data may include red grayscale data R, green grayscale data G and blue grayscale data B. The output YCbCr data YCbCr' may be converted to the output image data RGB' by a traditional and/or well-known method.

Figure 4A:
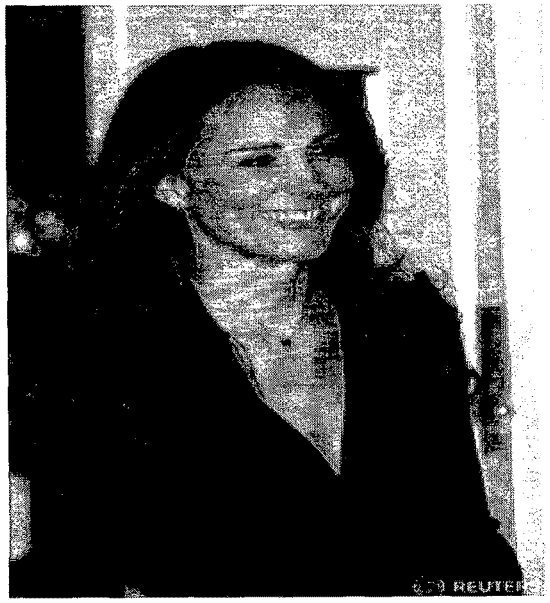
FIGS. 4A, 4B, and 4C are figures to explain image processing of the transparent liquid crystal display apparatus of FIG. 1 when an image has V-type grayscale distribution.
Figure 4B:
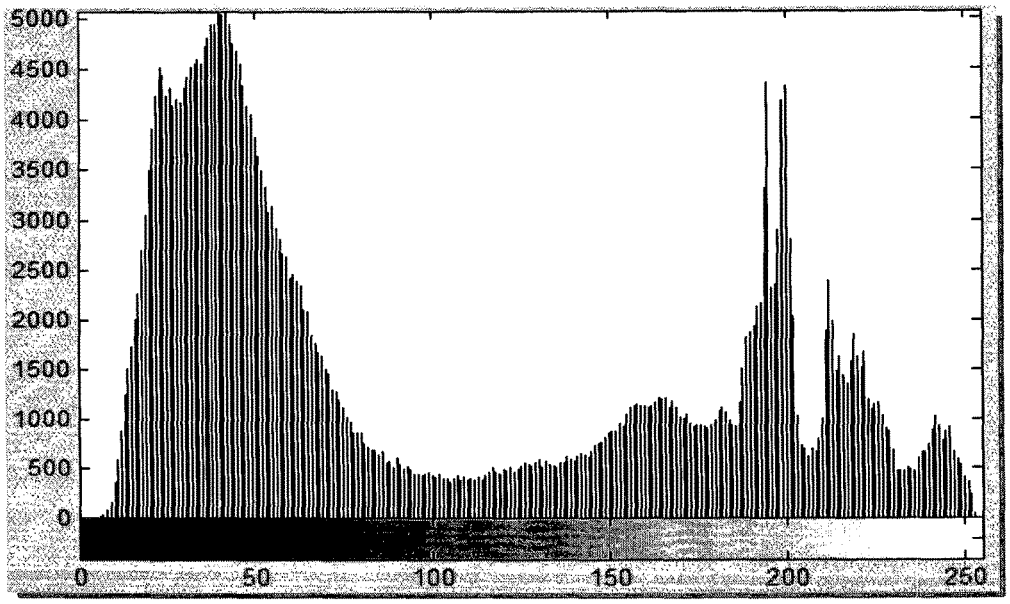
Figure 4C:
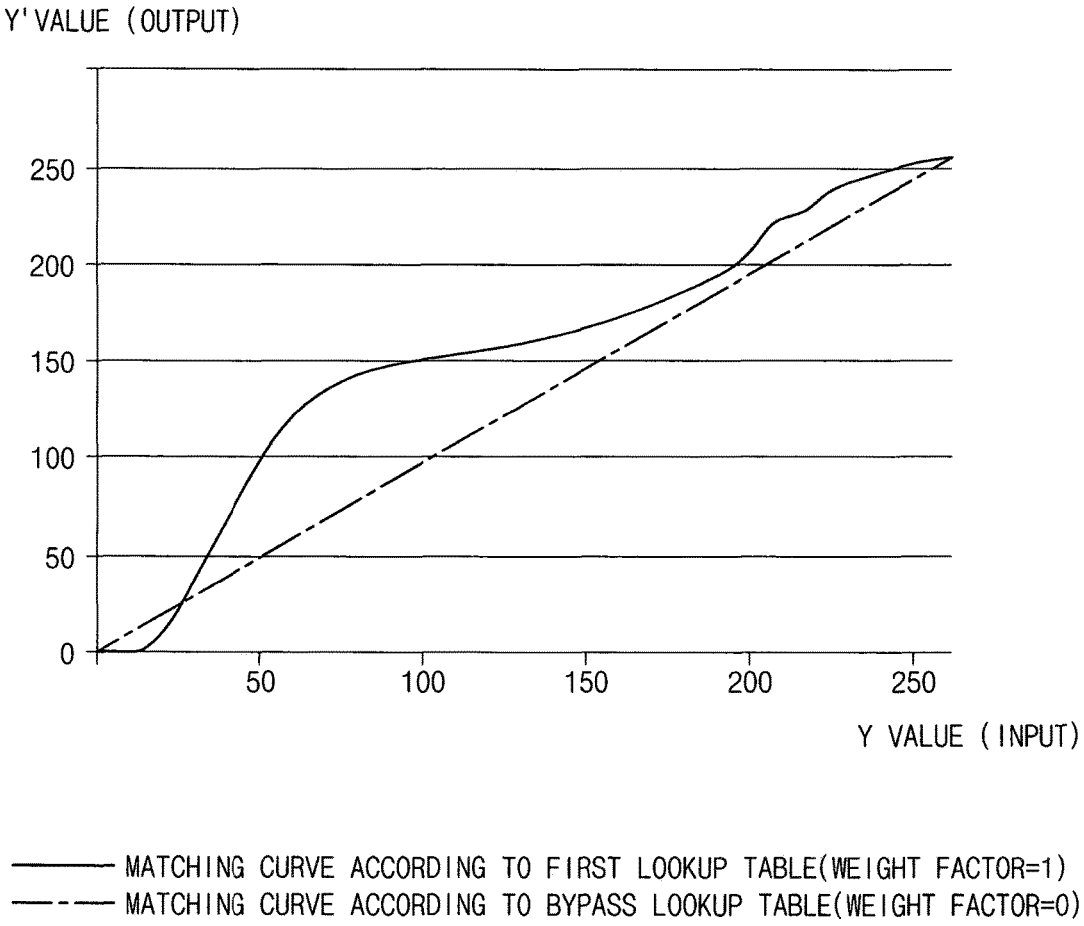

FIGS. 4A to 4C are figures to explain image processing of the transparent liquid crystal display apparatus of FIG. 1 when an image has a V-type grayscale distribution.

FIG. 4A is a first input image. The first input image includes a plurality of input pixel data for a plurality of pixels. Each of the input pixel data may include red grayscale data, green grayscale data and blue grayscale data.

FIG. 4B is a histogram of the first input image. An x-axis of the histogram represents brightness data values (from 0 to 255), and a y-axis represents frequency (the total number of instances of each brightness data value). Analyzing the first input image, the first input image may be determined as a V-type, which has more information at a low and high grayscale than at a middle grayscale.

FIG. 4C is a graph to explain a first lookup table for the input image data which is determined as the V-type. An x-axis represents brightness data Y which is an input, and a y-axis represents output brightness data Y' which is an output. A solid line on the graph is a matching curve of input and output according to the first lookup table when correction has been performed (weight factor=1). A dot-dash line of the graph is a matching curve of input and output according to a bypass lookup table (weight factor=0).

The solid line may be properly adjusted as required. For example, inclination of the solid line for the low and high grayscale may be adjusted to be enlarged, so that a representable grayscale range may be broadened where the image information of a low or high grayscale is greater than other. Thus, the low and high grayscale range having more image information is widened, and the middle grayscale range having less image information is narrowed, so that display quality of the transparent liquid crystal display apparatus may be improved even though the ambient light is weak.

Figure 5A:
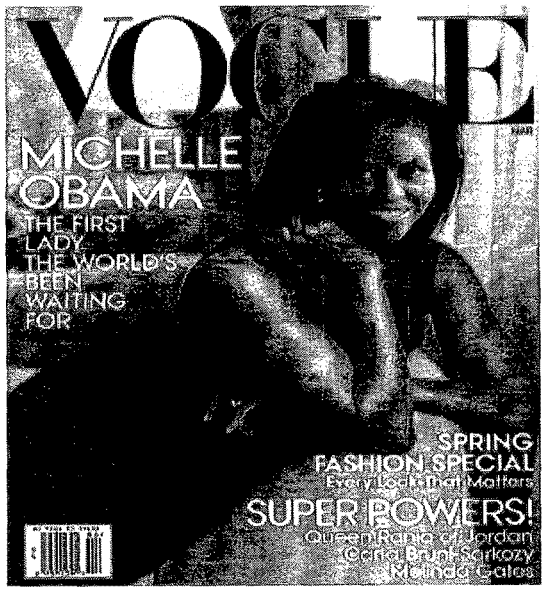
FIGS. 5A, 5B, and 5C are figures to explain image processing of the transparent liquid crystal display apparatus of FIG. 1 when an image has A-type grayscale distribution.
Figure 5B:
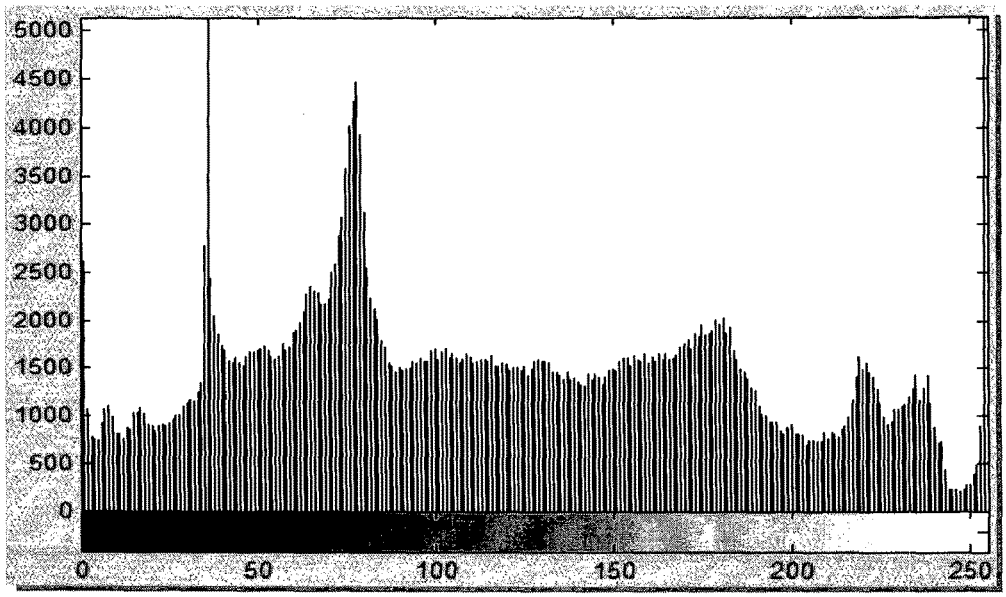
Figure 5C:
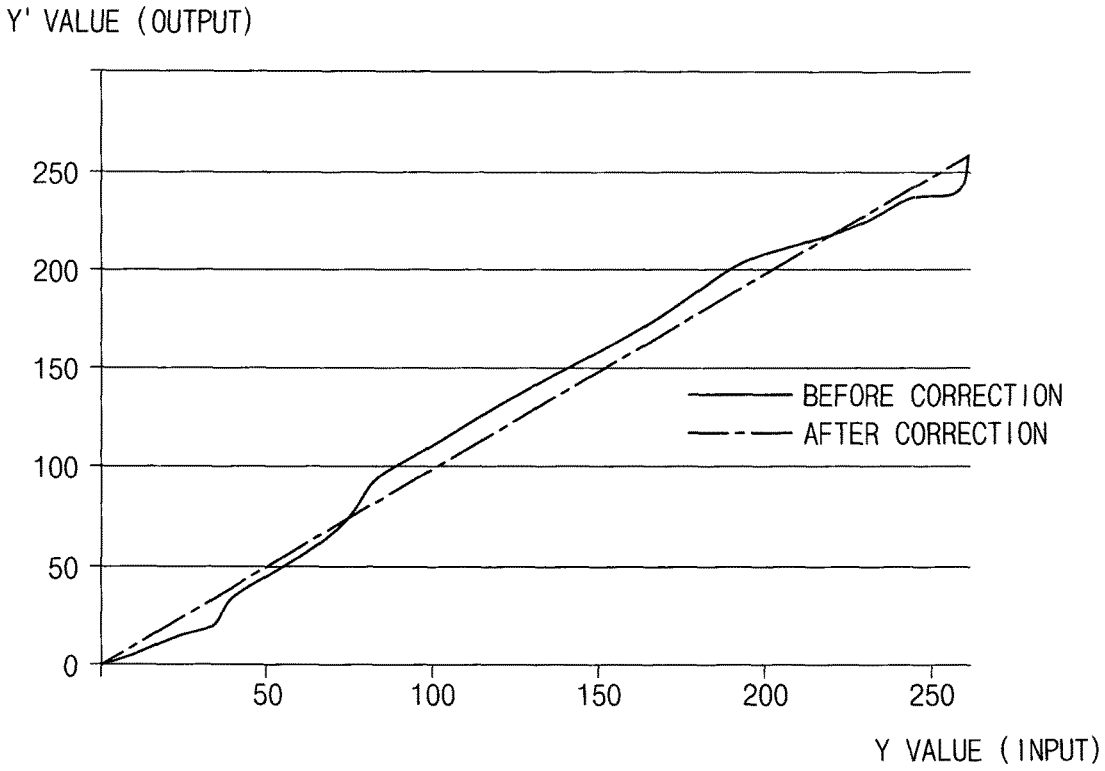

FIGS. 5A to 5C are figures to explain image processing of the transparent liquid crystal display apparatus of FIG. 1 when an image has an A-type grayscale distribution.

FIG. 5A is a second input image. The second input image includes a plurality of input pixel data for a plurality of pixels. Each of the input pixel data may include red grayscale data, green grayscale data and blue grayscale data. The second input image may include a grayscale distribution different from that of the first input image.

FIG. 5B is a histogram of the second input image. An x-axis of the histogram represents brightness data value (0 to 255), and a y-axis represents frequency (the number of each brightness data). Analyzing the second input image, the second input image may be determined as an A-type which has more information at middle grayscale than at low and high grayscale.

FIG. 5C is a graph to explain a second lookup table for the input image data which is determined as the A-type. An x-axis represents brightness data Y which is input, and a yz-axis represents brightness data Y' which is output. A solid line on the graph is a matching curve of input and output according to the second lookup table when correction has been performed (weight factor=1). A dot-dash line of the graph is a matching curve of input and output according to a bypass lookup table (weight factor=0).

The solid line may be properly adjusted as required. For example, by boosting output at the middle grayscale, brightness may be overall increased at the middle grayscale, which may have more image information. Thus, brightness at the middle grayscale which may have more image information than at high and low grayscale is overall increased, so that display quality of the transparent liquid crystal display apparatus may be improved even though the ambient light is weak.

Figure 6:
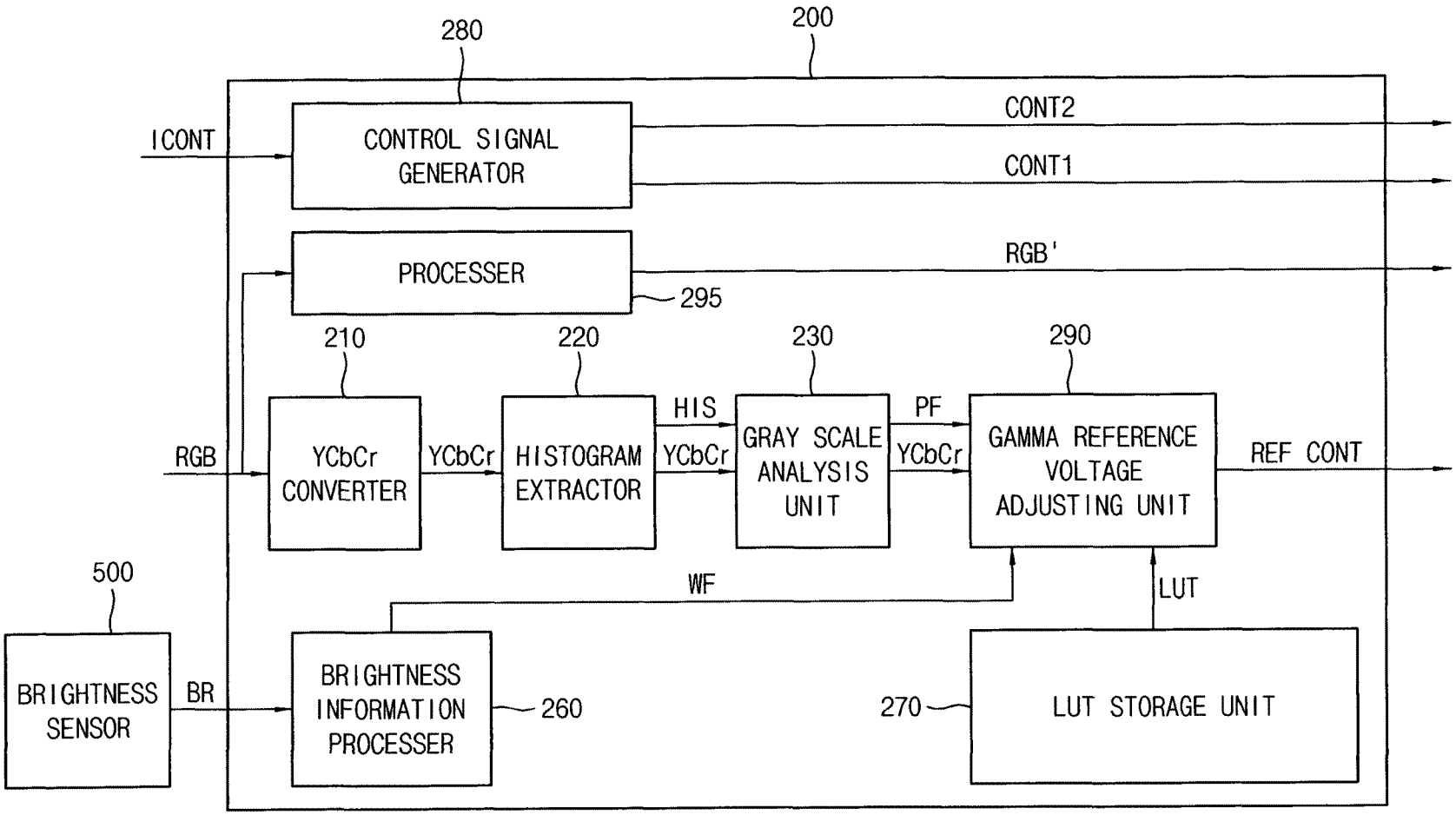
FIG. 6 is a block diagram of a timing controller of a transparent liquid crystal display apparatus according to an exemplary embodiment of the inventive concept.

FIG. 6 is a block diagram of a timing controller of a transparent liquid crystal display apparatus according to an exemplary embodiment of the inventive concept.

Referring to FIG. 6, the timing controller is substantially the same as the timing controller of FIG. 2 except for a gamma reference voltage adjusting unit 290. Thus, any further detailed descriptions concerning the same elements will be briefly described or omitted.

The timing controller 200 includes a YCbCr converter 210, a histogram extractor 220, a grayscale analysis unit 230, a brightness information processer 260, LUT storage unit 270, a control signal generator 280, a gamma reference voltage adjusting unit 290 and a processer 295.

The YCbCr converter 210 receives the input image data RGB and converts the input image data RGB to a YCbCr data YCbCr, and then provides the YCbCr data YCbCr to the histogram extractor 220.

The histogram extractor 220 receives the YCbCr data YCbCr from the YCbCr converter 210, generates a histogram information HIS, and then provides the histogram information HIS to the grayscale analysis unit 230.

The grayscale analysis unit 230 receives the histogram information HIS from the histogram extractor 220, and determines a type of an input image by analyzing the histogram information HIS. The grayscale analysis unit 230 generates profile information PF which includes information about the type of the input image, and provides the profile information PF to the gamma reference voltage adjusting unit 290.

The brightness information processer 260 receives the ambient brightness information BR from the brightness sensor 500 and generates a weight factor WF.

The LUT storage unit 270 may store a gamma reference voltage for input value corresponding to each of the type of the input image. For example, the LUT storage unit 270 may store a lookup table LUT including input grayscale to gamma reference voltage mapping information for each of the type of the input image. In addition, the LUT storage unit 270 may further store the bypass lookup table which maps with a gamma reference voltage that outputs as the output grayscale the input grayscale. The LUT storage unit 270 may provide the information LUT which is about the lookup table and the bypass lookup table to the gamma reference voltage adjusting unit 290.

The gamma reference voltage adjusting unit 290 receives the profile information PF and the YCbCr data YCbCr, and generates a gamma reference voltage control signal REF CONT. The gamma reference voltage control signal REF CONT may adjust the gamma reference voltage of a driver IC of the data driving circuit 400. More specifically, the gamma reference voltage adjusting unit 290 may directly adjust the gamma reference voltage using the information LUT in consideration of the profile information PF. Here, the gamma reference voltage may be directly adjusted in consideration of the weight factor WF outputted from the brightness information processer 260.

In the present example embodiment, the gamma reference voltage of the driver IC of the data driving circuit is directly adjusted instead of converting the input image data to the output image data. Accordingly, in the present example embodiment, the lookup table may include only values that the gamma reference voltage can have (e.g., values corresponding to 14 steps), so that a correction process may be simply performed.

The processer 295 receives the input image data RGB, and outputs output image data RGB'. The processer 295 may be a traditional image processer for a traditional display panel. For example, the processer 295 may generate output image data RGB' from the input image data RGB based on gamma data, correction signal, and the like, The control signal generator 280 may receive the input control signal ICONT, and may generate the first control signal CONT1 and the second control signal CONT2 based on the input control signal ICONT. The first control signal CONT1 may be provided to the gate driver 300, and a driving timing of the gate driver 300 may be controlled based on the first control signal CONT1. The second control signal CONT2 may be provided to the data driver 400, and a driving timing of the data driver 400 may be controlled based on the second control signal CONT2.

Figure 7:
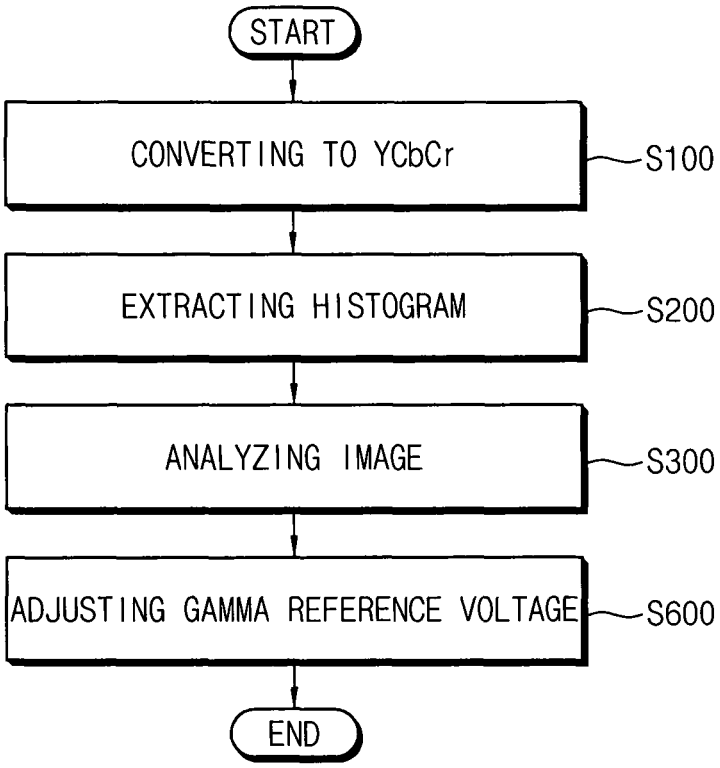
FIG. 7 is a flow chart illustrating a method of driving the transparent liquid crystal display apparatus of FIG. 5.

FIG. 7 is a flow chart illustrating a method of driving the transparent liquid crystal display apparatus of FIG. 6.

Referring to FIGS. 1, 6 and 7, the method includes converting to YCbCr (S100), extracting histogram (S200), analyzing image (S300), and adjusting gamma reference voltage (S600).

In converting to YCbCr (S100), an input image data RGB is received and converted to a YCbCr data YCbCr. The input image data RGB may include a plurality of input pixel data for a plurality of pixels. The input pixel data may include red grayscale data R, green grayscale data G and blue grayscale data B.

The YCbCr data YCbCr may include a plurality of YCbCr pixel data for the plurality of pixels. The YCbCr pixel data may include brightness data Y which is brightness information and a color difference CbCr data which is color information. The input image data RGB may be converted to the YCbCr data YCbCr by a traditional and/or well-known method.

In the extracting histogram (S200), histogram information HIS is generated based on the YCbCr data YCbCr. For example, the number of values (frequency distribution) which corresponds to each of the brightness data Y from the YCbCr pixel data of the YCbCr data YCbCr may be counted, and a histogram of frequency distribution of the brightness data Y of the YCbCr pixel data may be generated.

In analyzing image (S300), a type of an input image is determined by analyzing the histogram information HIS. For example, the histogram information HIS may be analyzed, and the type of the input image may be determined as an A-type when the frequency distribution is relatively high at the middle thereof. The type of the input image may be determined as a V-type when the frequency distribution is relatively low at the middle thereof. In addition, the type of the input image may be a type other than the V-type or A-type.

In adjusting gamma reference voltage (S600), a gamma reference voltage of the driver IC which corresponds to the brightness data Y of the YCbCr data YCbCr may be directly adjusted according to the type of the input image. For example, using a lookup table LUT which is set according to the type of the input image, the gamma reference voltage may be mapped from the brightness data Y of the YCbCr data YCbCr. Here, the gamma reference voltage may be adjusted using the weight factor WF, which is set to a value from 0 to 1 according to the ambient brightness information BR.

According to the present inventive concept, a timing controller of a transparent liquid crystal display apparatus extracts a brightness histogram from input image data and generates output image data so that its dynamic range is improved. Brightness of an ambient light is sensed and a weight factor is applied, so that visibility of an image displayed on the transparent liquid crystal display apparatus may be improved regardless of the brightness of an ambient light.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A transparent liquid crystal display apparatus, comprising:

a transparent display panel comprising a liquid crystal layer;

a timing controller configured to receive an input image data and output an output image data; and a brightness sensor configured to sense a brightness of an ambient light and provide an ambient brightness information to the timing controller, wherein the input image data comprises a plurality of input pixel data, each of which comprises a red grayscale data, a green grayscale data and a blue grayscale data, and wherein the timing controller comprises:

a YCbCr converter configured to convert the input pixel data to YCbCr data, wherein the YCbCr data comprises YCbCr pixel data for a plurality of pixels, and each of the YCbCr data has a brightness data corresponding to a pixel of the plurality of pixels;

a histogram extractor configured to receive the YCbCr data and generate a histogram information comprising a number of values corresponding to each of the brightness data;

a grayscale analysis unit configured to analyze the histogram information and determine a type of an input image by counting a number of low brightness values from the histogram information, and counting a number of high brightness values from the histogram information, wherein the low brightness values are each smaller than a reference low brightness, and the high brightness values are each greater than a reference high brightness, wherein a number of middle brightness values is determined by subtracting a sum of the number of low brightness values and the number of high brightness values from a total number of brightness values of the histogram information, wherein the type of the input image is determined as the V-type when a ratio of the number of middle brightness values to the total number of the brightness values is smaller than a reference low ratio, and wherein the type of the input image is determined as the A-type when a ratio of the number of middle brightness values to the total number of the brightness values is larger than a reference high ratio;

an image processer configured to process the YCbCr data according to the type of the input image and the ambient brightness information and generate an output YCbCr' data; and an RGB converter configured to convert the output YCbCr' data to the output image data, wherein the output image data comprises an output pixel data each of which comprises a red grayscale data, a green grayscale data and a blue grayscale data.

2. The transparent liquid crystal display apparatus of claim 1, wherein the grayscale analysis unit determines the type of the input image as an A-type when a frequency distribution of the histogram information is relatively high at a middle of the frequency distribution, and wherein the grayscale analysis unit is further configured to determine the type of the input image as a V-type when the frequency distribution of the histogram information is relatively low at the middle of the frequency distribution.

3. The transparent liquid crystal display apparatus of claim 1, wherein the brightness data is from 0 to 255, the reference low brightness is 85, the reference high brightness is 170, the reference low ratio is 30%, and the reference high ratio is 70%.

4. The transparent liquid crystal display apparatus of claim 1, further comprising a LUT storage unit which stores a lookup table having an input to output mapping information for each of the type of the input image.

5. The transparent liquid crystal display apparatus of claim 4, wherein in the lookup table, an output range corresponding to a brightness data range having more image information is set to be widened, and an output range corresponding to a brightness data range having less image information is set to be narrowed.

6. The transparent liquid crystal display apparatus of claim 5, wherein the LUT storage unit further comprises a bypass lookup table which outputs an input value as it is.

7. A transparent liquid crystal display apparatus, comprising:

a transparent display panel comprising a liquid crystal layer;

a timing controller configured to receive an input image data and output an output image data; and a brightness sensor configured to sense a brightness of an ambient light and provide an ambient brightness information to the timing controller, wherein the input image data comprises a plurality of input pixel data, each of which comprises a red grayscale data, a green grayscale data and a blue grayscale data, and wherein the timing controller comprises:

a YCbCr converter configured to convert the input pixel data to YCbCr data, wherein the YCbCr data comprises YCbCr pixel data for a plurality of pixels, and each of the YCbCr data has a brightness data corresponding to a pixel of the plurality of pixels;

a histogram extractor configured to receive the YCbCr data and generate a histogram information comprising a number of values corresponding to each of the brightness data;

a grayscale analysis unit configured to analyze the histogram information and determine a type of an input image;

an image processer configured to process the YCbCr data according to the type of the input image and the ambient brightness information and generate an output YCbCr' data;

an RGB converter configured to convert the output YCbCr' data to output image data, wherein the output image data comprises an output pixel data each of which comprises a red grayscale data, a green grayscale data and a blue grayscale data; and a LUT storage unit which stores a lookup table having an input to output mapping information for each of the type of the input image, wherein the LUT storage unit further comprises a bypass lookup table which outputs an input value as it is, wherein in the lookup table, an output range corresponding to a brightness data range having more image information is set to be widened, and an output range corresponding to a brightness data range having less image information is set to be narrowed, wherein the image processer generates the output YCbCr' data which comprises output brightness data using the equation below:

$$\text{output brightness data } Y' = \text{bypass lookup table}(Y) + (\text{lookup table}(Y) - \text{bypass lookup table}(Y)) * \text{weight factor WF} \quad \text{[equation]}$$

(Here, the bypass lookup table(Y) means output of the bypass lookup table corresponding to the input brightness data Y, lookup table(Y) means output of the lookup table for each of the type of the input image corresponding to the input brightness data Y, weight factor WF has a value 0 to 1 according to the ambient brightness information).

8. A method of driving a transparent liquid crystal display apparatus, comprising:

converting an input image to a YCbCr data;

extracting a histogram comprising a brightness data from the YCbCr data;

analyzing the histogram to determine a type of the input image, wherein analyzing the histogram produces a histogram information, and comprises:

counting a number of low brightness values from the histogram information and counting a number of high brightness values from the histogram information, and wherein the low brightness values are each smaller than a reference low brightness, and the high brightness values are each greater than a reference high brightness, wherein a number of middle brightness values is determined by subtracting a sum of the number of low brightness values and the number of high brightness values from atotala total number of brightness values of the histogram information, wherein the type of the input image is determined as the V-type when a ratio of a number of middle brightness values to the total number of the brightness values is smaller than a reference low ratio, wherein the type of the input image is determined as the A-type when a ratio of the number of middle brightness values to the number of the entire brightness values is larger than a reference high ratio, and wherein in generating output YCbCr data, a first lookup table and a second lookup table, which have input to output mapping information for the V-type and A-type, respectively, are used;

generating an output YCbCr' data from the YCbCr data according to the type of the input image; and converting the output YCbCr' data to an output image comprising a red grayscale data, a green grayscale data and a blue grayscale data.

9. The method of claim 8, further comprising:

sensing a brightness of an ambient light, wherein the output YCbCr' data is generated by application of a weight factor, the weight factor being dependent on the brightness of the ambient light.

10. The method of claim 9, wherein the weight factor is relatively large when the ambient light is relatively weak, and is relatively small when the ambient light is relatively strong.

11. The method of claim 10, wherein in generating the output YCbCr data, a lookup table which comprises an input to output mapping information for each of the type of the input image is used.

12. The method of claim 10, wherein the input to output mapping information of the lookup table is set such that an output range corresponding to a brightness data range having more image information is set to be widened, and an output range corresponding to a brightness data range having less image information is set to be narrowed.

13. The method of claim 9, wherein when the brightness of the ambient light is smaller than 5 nt, the weight factor has a value 1, when the brightness of the ambient light is greater than 400 nt, the weight factor has a value of 0, and when the brightness of the ambient light is between 5 nt and 400 nt, the weight factor has a value between 0 and 1.

14. The method of claim 8, wherein in analyzing the histogram, the type of the input image is determined as high-type when the histogram information has relatively large information at a high brightness range which is greater than a reference high brightness, wherein the type of the input image is determined as middle-type when the histogram information has relatively large information at a middle brightness range which is between a reference low brightness and the high reference brightness, wherein the type of the input image is determined as low-type when the histogram information has relatively large information at low brightness range which is smaller than a reference high brightness, and wherein in generating output YCbCr data, a first lookup table, a second lookup table, and a third lookup table, which have input to output mapping information for the high-type, the middle-type and the low-type, respectively, are used.

15. The method of claim 8, further comprising:

directly adjusting a gamma reference voltage of a driving circuit according to the type of the input image.

16. A method of driving a transparent liquid crystal display apparatus, comprising:

converting an input image to a YCbCr data;

extracting a histogram comprising a brightness data from the YCbCr data;

analyzing the histogram to determine a type of the input image;

generating an output YCbCr data from the YCbCr data according to the type of the input image;

converting the output YCbCr' data to an output image comprising a red grayscale data, a green grayscale data and a blue grayscale data; and sensing a brightness of an ambient light, wherein the output YCbCr' data is generated by application of a weight factor, the weight factor being dependent on the brightness of the ambient light, wherein the weight factor is relatively large when the ambient light is relatively weak, and is relatively small when the ambient light is relatively strong wherein the input to output mapping information of the lookup table is set such that an output range corresponding to a brightness data range having more image information is set to be widened, and an output range corresponding to a brightness data range having less image information is set to be narrowed, wherein the output YCbCr' data which comprises output brightness data is calculated using the equation below:

output brightness data $Y'$=bypass lookup table($Y$)+
(lookup table($Y$)−bypass lookup table ($Y$))
*weight factor WF [equation]

(Here, the bypass lookup table(Y) means output of the bypass lookup table corresponding to the input brightness data Y, lookup table(Y) means output of the lookup table for each of the type of the input image corresponding to the input brightness data Y, weight factor WF has a value 0 to 1 according to the ambient brightness information, bypass lookup table outputs input value as it is).

* * * * *